US005988152A

United States Patent [19]

Halter et al.

[11] Patent Number: 5,988,152

[45] **Date of Patent: *Nov. 23, 1999**

[54] TOY GUN FOR SEQUENTIALLY FIRING A PLURALITY OF PROJECTILES

[75] Inventors: Jeffrey T. Halter, Cincinnati; Brian S. Dengler, Liberty Township, both of Ohio

[73] Assignee: Hasbro, Inc., Pawtucket, R.I.

[ * ] Notice: This patent issued on a continued prosecution application filed under 37 CFR 1.53(d), and is subject to the twenty year patent term provisions of 35 U.S.C. 154(a)(2).

[21] Appl. No.: 09/053,483

[22] Filed: Apr. 1, 1998

[51] Int. Cl.[6] ..... F41B 11/00

[52] U.S. Cl. ..... 124/65; 124/66; 124/31

[58] Field of Search ..... 124/59, 63, 64, 124/65, 66, 67, 31

[56] References Cited

U.S. PATENT DOCUMENTS

| | | | |
|---|---|---|---|
| 399,882 | 3/1889 | Graydon | 124/56 |
| 1,171,197 | 2/1916 | Harmon, Jr. | 124/65 |
| 1,217,553 | 2/1917 | Beatty | 124/16 |
| 1,478,597 | 12/1923 | Bebler | 124/73 |
| 2,196,732 | 4/1940 | Lefever | 124/11 |
| 2,214,224 | 9/1940 | Douglas | 124/15 |
| 2,237,678 | 4/1941 | Lohr et al. | 124/11 |
| 2,630,108 | 3/1953 | White | 124/13 |
| 3,009,453 | 11/1961 | Ayala | 124/27 |
| 3,010,729 | 11/1961 | Tomosy | 280/1.181 |
| 3,111,121 | 11/1963 | Baggott | 124/15 |
| 3,119,385 | 1/1964 | Ashley | 124/19 |
| 3,262,440 | 7/1966 | Kuhn | 124/15 |
| 3,465,744 | 9/1969 | Nielsen | 124/27 |
| 3,540,426 | 11/1970 | Lohr et al. | 124/15 |
| 3,612,026 | 10/1971 | Vadas et al. | 124/11 |
| 3,627,367 | 12/1971 | Levy | 294/16 |
| 3,774,586 | 11/1973 | Saito | 124/29 |
| 3,913,553 | 10/1975 | Braughler et al. | 124/15 |
| 4,223,658 | 9/1980 | Sundstrom | 124/19 |
| 4,696,654 | 9/1987 | Welch et al. | 446/268 |
| 4,848,307 | 7/1989 | Tsao | 124/59 |
| 5,156,137 | 10/1992 | Clayton | 124/27 |
| 5,186,156 | 2/1993 | Clayton | 124/59 |
| 5,267,549 | 12/1993 | Webber | 124/65 |
| 5,323,755 | 6/1994 | Hsieh | 124/66 |
| 5,460,150 | 10/1995 | Joppe | 124/19 |
| 5,522,374 | 6/1996 | Clayton | 124/59 |
| 5,535,729 | 7/1996 | Griffin et al. | 124/66 |
| 5,564,964 | 10/1996 | Chin-Chien | 446/406 |
| 5,592,931 | 1/1997 | Johnson et al. | 124/69 |
| 5,660,159 | 8/1997 | Clayton | 124/66 |
| 5,738,079 | 4/1998 | Keller et al. | 124/66 |
| 5,797,385 | 8/1998 | Thai | 124/66 |

FOREIGN PATENT DOCUMENTS 2 250 574 6/1992 United Kingdom .

OTHER PUBLICATIONS

Drucker et al., co–pending U.S. Patent Application Serial No. 08/797,090, filed Feb. 7, 1997 for "Projectile Launcher With Articulated Cocking Mechanism".

*Primary Examiner*—J. Woodrow Eldred
*Attorney, Agent, or Firm*—Marshall, O'Toole, Gerstein, Murray & Borun

[57] ABSTRACT

A toy gun which fires at least two projectiles with a single cycle of an actuation device is disclosed. The gun includes a piston for developing a firing force and a magazine having at least two stations, each of which receives a projectile. The magazine is movable to sequentially position each of the stations in a firing position to receive the firing force from the piston. The actuating device operatively engages the piston and the magazine for periodic actuation thereof. In some embodiments, the actuating device comprises an elongated strip with a plurality of spaced abutments.

24 Claims, 6 Drawing Sheets

TOY GUN FOR SEQUENTIALLY FIRING A PLURALITY OF PROJECTILES

FIELD OF THE INVENTION

The present invention relates generally to toy guns and, more particularly, to toy guns which sequentially fire a plurality of projectiles.

BACKGROUND OF THE INVENTION

For many years, toy guns have been very popular with children of various ages. Some of the earliest and crudest toy guns consisted of little more than a block of wood carved to resemble a real gun. Over time many efforts have been made to develop improved toy guns that better capture and hold the attention of children. Through this process, more sophisticated toys have been developed.

For example, in recent years, toy guns which launch harmless projectiles have become popular. In one example of such guns, soft foam projectiles are launched by a blast of air developed by a reciprocating plunger contained within a toy gun housing. These guns are advantageous in that the projectiles and the air blast developed by the reciprocating plunger are harmless, and the moving plunger is safely contained within the housing thereby ensuring that no injury can result from use of the toy.

The toy market changes rapidly. Children are constantly interested in toys with new features. Therefore, it is desirable to develop new toy guns with new functions and features which will capture the interest of children and provide increased play value.

SUMMARY OF THE INVENTION

In accordance with an aspect of the invention, the present invention improves upon the prior art by providing a toy gun for firing at least two projectiles with a single cycle of an actuating means. The toy gun includes a housing defining a chamber. It also includes a piston arranged for reciprocating motion relative to the chamber between first and second positions, and a piston spring for biasing the piston towards the second position. The piston forces air from the chamber when it moves from the first to the second position. The toy gun also includes a magazine having at least two stations; each of which is adapted to receive a projectile. The magazine is movable for sequentially positioning each of the stations in a firing position to receive the air forced from the chamber by the piston. The actuating means of the toy gun is in operative engagement with the piston and the magazine for actuating the piston and the magazine in synchronization such that air forced from the chamber by the piston is sequentially applied to the at least two stations whereby at least two projectiles can be sequentially fired by a single cycle of the actuating means.

In some embodiments, the toy gun is provided with a camming surface which forces a projection associated with the piston to separate from the actuating means when the piston reaches the first position thereby releasing the piston for movement from the first position to the second position.

In any of the foregoing embodiments, the actuating means may comprise an elongated strip which is movable relative to the piston and magazine. Preferably, the strip includes a plurality of spaced abutments, at least one of which periodically operatively engages the projection to thereby impart movement of the strip to the piston. Preferably, the abutments are spaced to periodically permit the piston to move from the first position to the second position without interference therefrom.

In some embodiments, the magazine is substantially cylindrical and includes a groove on its outer periphery. In such embodiments, the actuating means periodically interacts with the groove to rotate the magazine through a predefined angle.

If the actuating means is implemented by a strip of the above type, the strip can extend beyond the housing and include a first handle to facilitate pulling of the strip by a user. In such instances, the strip preferably includes a second handle at an end of the strip opposite the first handle whereby the strip can be reciprocated through the housing between a loaded position and a fired position.

Alternatively, if the actuating means is implemented by a strip, it can be configured as an endless loop. In such an approach, the toy gun can be provided with a crank and a gear for rotating the strip to thereby sequentially fire the toy gun.

In accordance with a further aspect of the invention, a toy gun for firing projectiles is provided. The toy gun includes a housing; a piston for developing a firing force; a magazine having at least two stations; and an elongated strip. Each of the stations in the magazine is adapted to receive a projectile. The magazine is movable for sequentially positioning each of the stations in a firing position to receive the firing force developed by the piston. The elongated strip includes a plurality of spaced abutments for periodically actuating the piston and the magazine such that force developed by the piston is sequentially applied to the at least two stations.

Other features and advantages are inherent in the apparatus claimed and disclosed or will become apparent to those skilled in the art from the following detailed description and its accompanying drawings.

DESCRIPTION OF THE PREFERRED EMBODIMENTS

Figure 1:
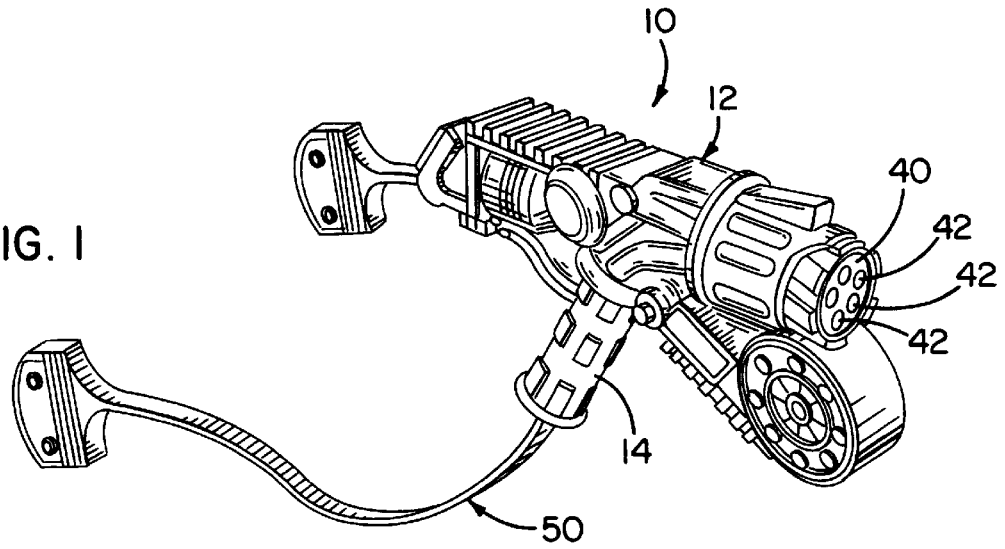
FIG. 1 is a right, front perspective view of a toy gun constructed in accordance with the teaching of the instant invention.

A toy gun 10 constructed in accordance with the teachings of the invention is illustrated in FIG. 1. Although in the illustrated embodiment, the gun 10 is adapted for shooting harmless projectiles with a blast of air, persons of ordinary skill in the art will appreciate that the teachings of the invention are not limited to toy guns which shoot projectiles, to toy guns which shoot any particular type of projectile, or to toy guns which include any particular type of projectile actuating mechanism. On the contrary, the teachings of the invention are applicable to any toy gun which would benefit from one or more of the features disclosed herein including, by way of example, not limitation, toy guns that fire projectiles with a spring or with a spring loaded firing pin or the like.

As shown in FIG. 1, the toy gun 10 is preferably provided with a housing 12 shaped to visually resemble a gun. Although in the preferred embodiment, the housing 12 is constructed to resemble a futuristic gun, persons of ordinary skill in the art will appreciate that the teachings of the invention are in no way limited to any particular type of toy gun appearance. Thus, the housing 12 can be constructed to have any desired appearance without departing from the scope or spirit of the invention.

In the illustrated embodiment, the housing 12 includes a handle 14. The handle 14 provides a grip to facilitate holding and firing the gun 10 as explained further below.

Figure 7:
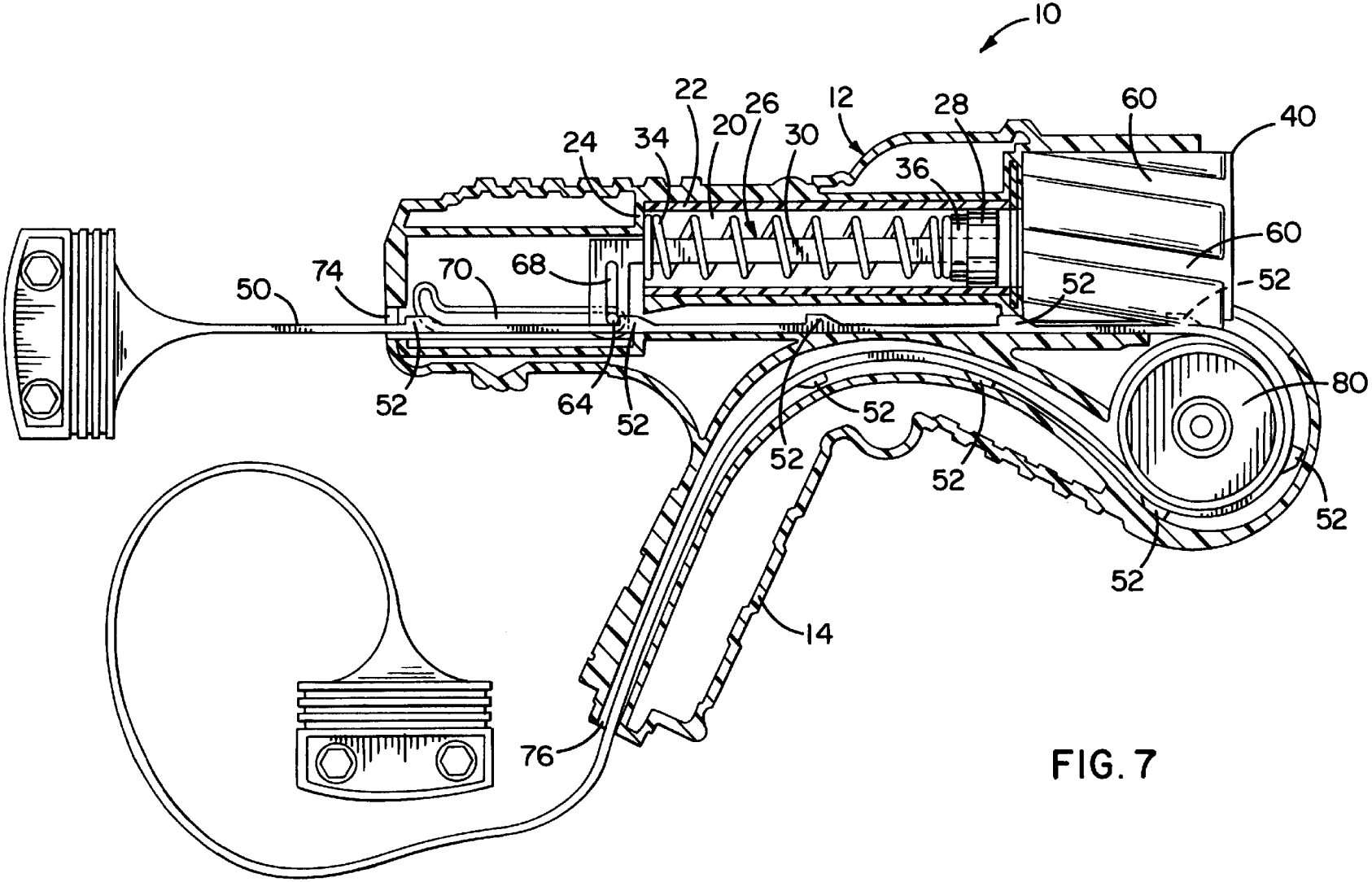
FIG. 7 is a cross-sectional view of the toy gun taken along lines 7—7 of FIG. 6 and showing the piston in the fired position.

In the illustrated embodiment, the toy gun 10 is adapted to fire harmless projectiles with a blast of air. To this end, the housing 12 contains an internal air chamber 20. As shown in FIG. 7, the internal air chamber 20 is preferably defined by a cylindrical body or can 22 mounted within the housing 12 and having an open distal end. The proximal end of the can 22 includes a proximal wall 24 defining an aperture.

For the purpose of developing a force sufficient to expel a projectile from the gun 10, the gun 10 is provided with means for forcing air from the chamber 20. In the illustrated embodiment, the forcing means comprises a piston 26 disposed within the cylindrical can 22 for reciprocating motion relative to the chamber 20 between a cocked position (see FIG. 8) and a fired position (see FIG. 7).

As shown in FIG. 7, the distal end of the piston 26 preferably includes a circular head 28 which is sized to slidingly engage the inner cylindrical surface of the can 22 defining the chamber 20. The piston 26 further includes a shaft 30 extending proximally from the circular head 28. The shaft 30 extends through the aperture defined in the proximal wall 24 of the cylindrical can 22.

Figure 8:
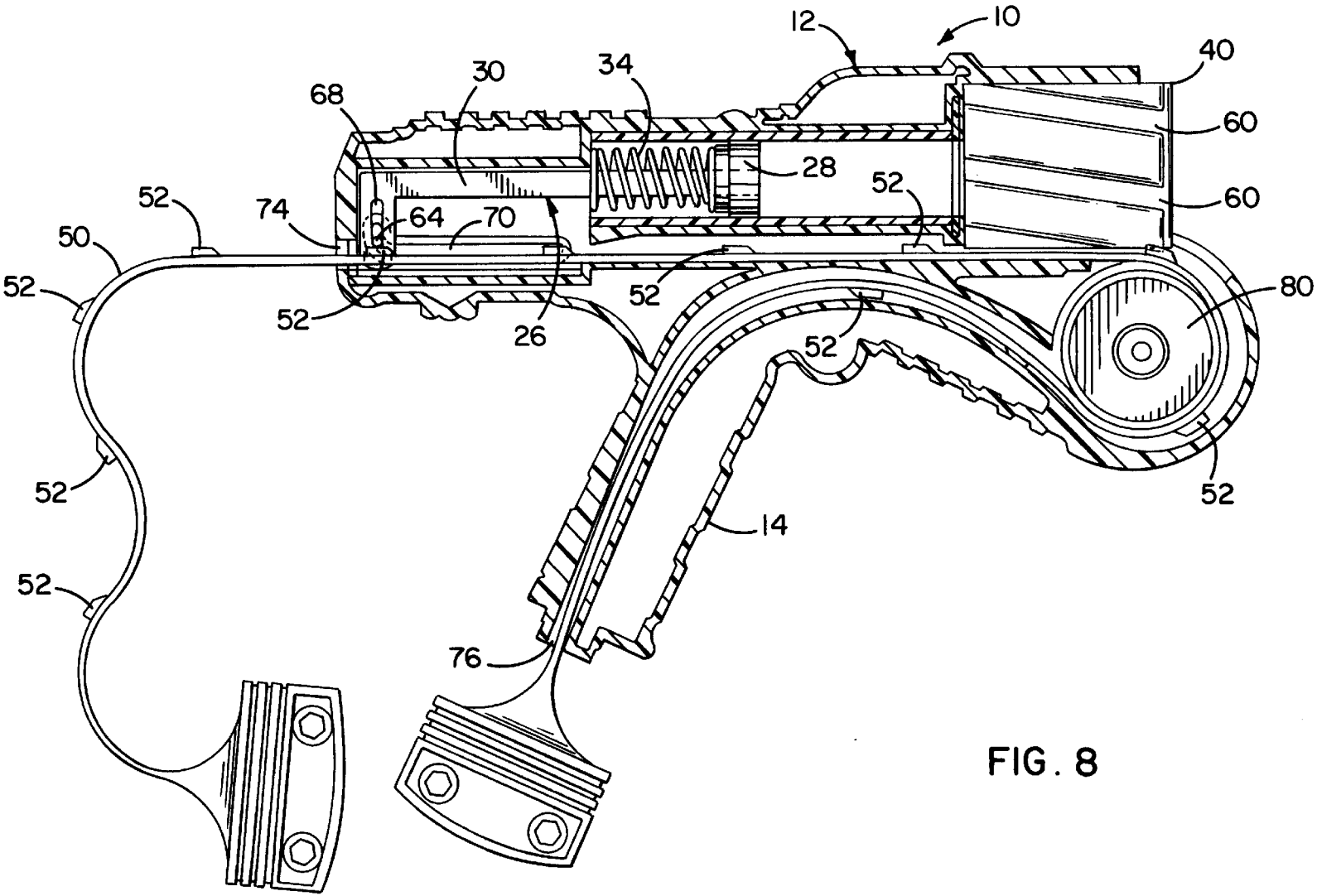
FIG. 8 is a view similar to FIG. 7 but showing the piston in the cocked position.

To bias the piston 26 towards the fired position and to provide an actuating force, the gun 10 is further provided with a piston spring 34. As illustrated in FIGS. 7 and 8, the piston spring 34 is mounted concentrically around the shaft 30 of the piston 26 within the air chamber 20. The proximal end of the spring 34 abuts the proximal wall 24 of the cylindrical can 22. The distal end of the spring 34 abuts an extension 36 of the circular head 28. Thus, when the piston 26 is moved from the fired position (FIG. 7) to the cocked position (FIG. 8), the spring 34 is compressed within the proximal portion of the air chamber 20 as shown in FIG. 8. When the piston 26 is released from the cocked position, the force of the spring 34 moves the piston 26 to the fired position such that the circular head 28 of the piston 26 forces air out of the open distal end of the chamber 20.

Figure 11:
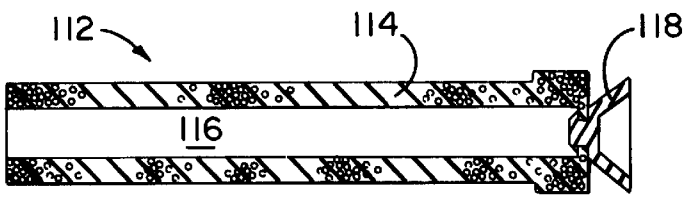
FIG. 11 is a cross-sectional view of a representative projectile for use with the toy gun of FIGS. 1–8 and/or 9–10.

A preferred projectile 112 is shown in FIG. 11. The projectile 112 preferably comprises a cylindrical body 114 defining a central lumen 116. The proximal end of the lumen 116 is open to receive air expelled from the chamber 20. The distal end of the projectile 112 is substantially sealed by a pliable cup 118 made of rubber or the like. When a blast of air exits the chamber 20 and enters the projectile lumen 116, the interaction of the forced air and the sealed end of the lumen 116 propels the projectile out of the gun 10 in a known manner.

Figure 5:
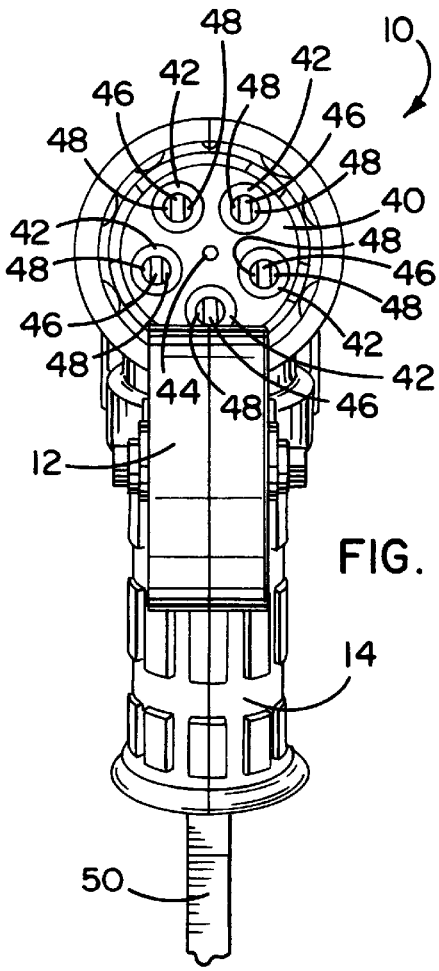
FIG. 5 is a front view of the toy gun.
Figure 6:
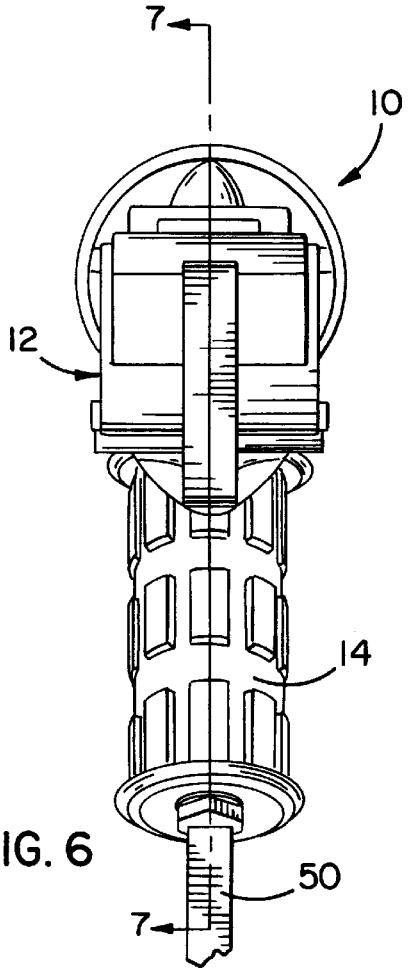
FIG. 6 is a rear view of the toy gun.
Figure 2:
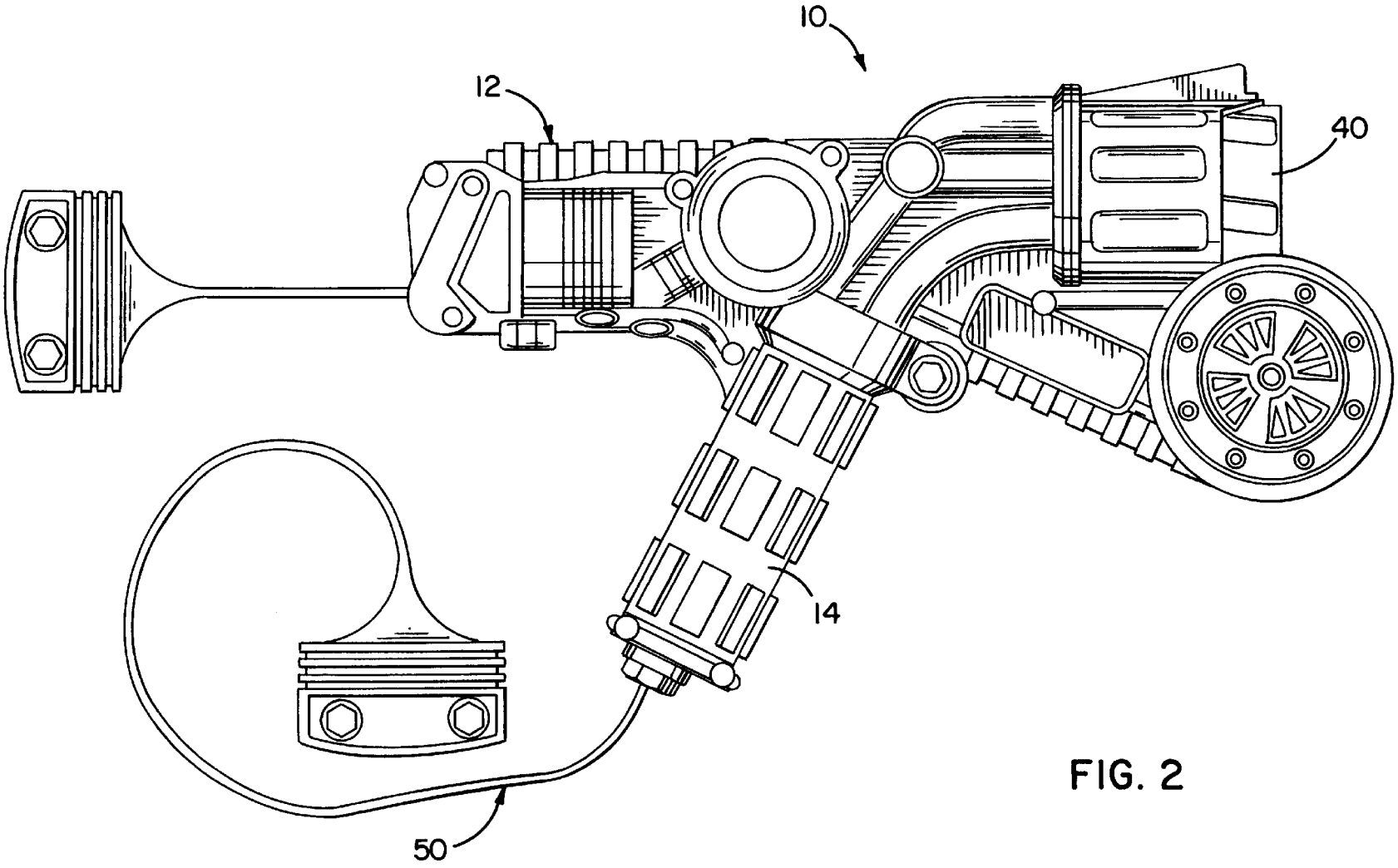
FIG. 2 is a right side view of the toy gun of FIG. 1
Figure 3:
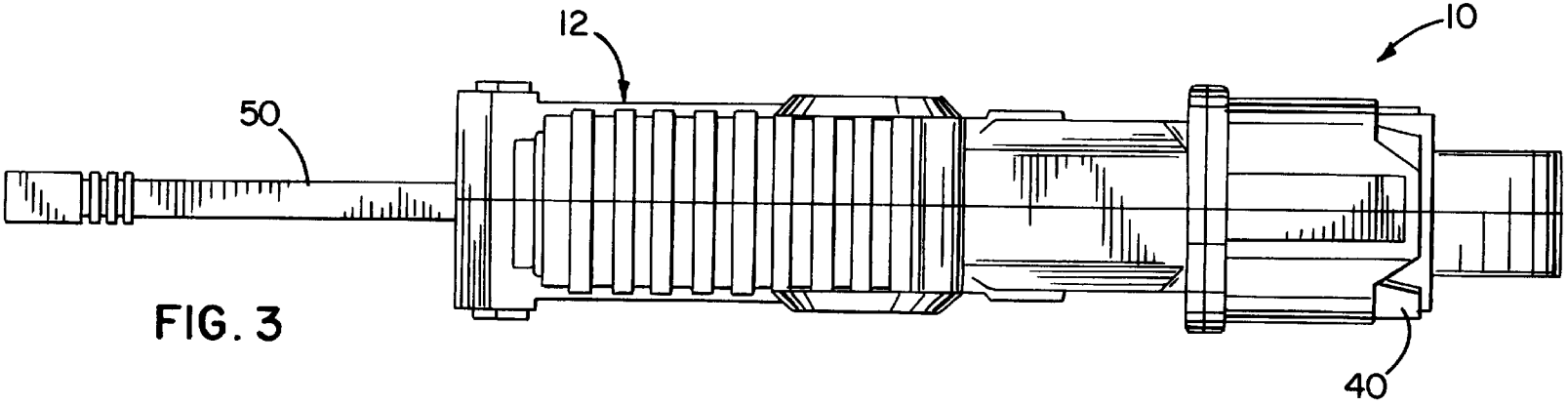
FIG. 3 is a top view of the toy gun.
Figure 4:
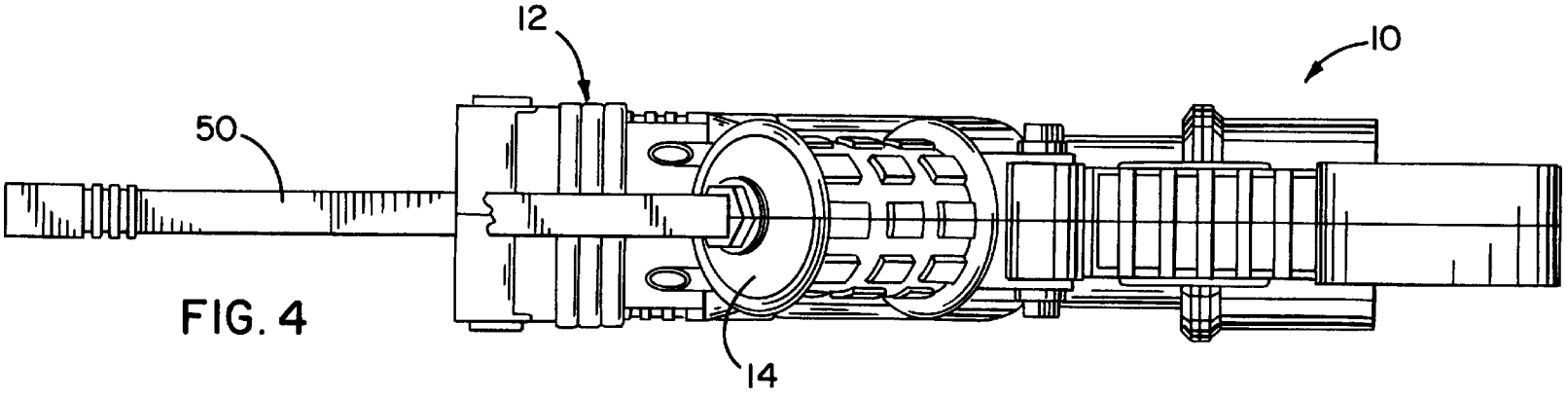
FIG. 4 is a bottom view of the toy gun.

In order to sequentially position projectiles in the path of the air forced from the air chamber 20, the toy gun 10 is further provided with a magazine 40. The magazine 40 is preferably implemented as a cylindrical body rotatably mounted in the distal end of the housing 12 for rotating motion about the central axis 44 of the cylinder. As best shown in FIG. 5, the magazine 40 includes a plurality of stations 42 spaced radially around the central axis 44. Each of the stations 42 is sized to receive a projectile 112. Thus, in the illustrated embodiment, the magazine 40 may simultaneously hold five projectiles 112. However, other numbers of stations and/or projectiles may be employed without departing from the scope or spirit of the invention.

The stations 42 are each preferably formed by a cylindrical chamber having open distal and proximal ends. To locate projectiles 112 within the cylindrical chambers, each station 42 is provided with a central post 46 (see FIG. 5) extending into the proximal end of the cylindrical chamber. Each of the central posts 46 is sized to slide into the central lumen 116 of a projectile 112 inserted into the corresponding station 42. Each post 46 is hollow and has an open proximal end and two openings 48 on its distal end. The posts 46, thus, form conduits for channeling air forced from the air chamber 20 into the lumens 116 of their respective projectiles 112 when the toy gun is fired.

The stations 42 are each preferably positioned at a predefined radial distance from the central axis 44 of the magazine 40 such that incrementally rotating the magazine 40 through predefined angles will sequentially position each of the stations 42 in a firing position. When the toy gun 10 is fired, air forced from the air chamber 20 by the piston 26 enters the central post 46 of the station 42 located in the firing position and is, thus, channeled into the lumen 116 of the projectile 112 located in that station 42. As a result, the projectile 112 is expelled from the gun 10. In the preferred embodiment, the stations 42 are equally spaced around the axis 44 so that repeatedly rotating the magazine 40 through the same incremental angle (in this instance, approximately 72°) sequentially positions each of the stations 42 in the firing position.

In order to reciprocate the piston 26 between the cocked and fired position while synchronously incrementally rotating the magazine 40 through the predefined angle, the apparatus 10 is provided with actuating means. The actuating means is in operative engagement with the piston 26 and the magazine 40 and actuates those structures in synchronization such that air forced from the chamber 20 by the piston 26 is sequentially applied to the stations 42. Preferably, multiple projectiles 112 can be fired by a single cycle of the actuating means.

In the preferred embodiment, the actuating means is implemented by an elongated strip 50 which is moveable relative to the piston 26 and the magazine 40. As shown in FIGS. 7 and 8, the elongated strip 50 includes a plurality of spaced abutments 52 for periodically operatively engaging the piston 26 and the magazine 40.

More specifically, as most easily seen in FIGS. 7 and 8, the outer surface of the magazine 40 includes a plurality of grooves 60. As shown in those figures, the grooves 60 are open at their distal and proximal ends and are positioned in angular relation to the front and back ends of the magazine 40. The grooves 60 are sized to slidably receive an abutment 52 of the strip 50 such that, if the strip 50 moves past the magazine 40 a sufficient distance, an abutment 52 enters and rides along one of the grooves 60. Since the grooves 60 are disposed at an angle to the longitudinal axis of the magazine 40, and since the section of the strip 50 adjacent the magazine 40 is positioned within the housing 12 for movement parallel to the longitudinal axis of the magazine 40, movement of an abutment 52 from one end of a groove 60 to another forces the magazine 40 to rotate through a predefined angle. In the preferred embodiment, the predefined angle is approximately 72°. Therefore, every time an abutment 52 passes through a groove 60, a new station 42 is rotated into the firing position.

For the purpose of selectively coupling the piston 26 to the actuating means, the piston 26 is provided with a projection 64 at its proximal end. In the illustrated embodiment, the projection 64 is implemented as a pin mounted for movement within a slot 64 defined in the proximal end of the piston 26. As shown in FIGS. 7 and 8, in the illustrated embodiment the slot 68 is oriented substantially perpendicular to the longitudinal axis of the piston 26 (i.e., substantially perpendicular to the plane of reciprocating movement of the piston 26). However, persons of ordinary skill in the art will readily appreciate that other orientations can be employed without departing from the scope of the invention.

In order to control the movement of the pin 64 within the slot 68, the pin 64 rides along a camming surface defined by the lower edge of a groove 70 defined in an internal surface of the housing 12. As shown in FIGS. 7 and 8, the camming surface preferably has a first section at its distal end which is oriented substantially parallel to the plane of movement of the piston 26, and a second section at its proximal end having a component which is oriented transverse to the plane of movement of the piston 26. The groove 70, thus, ensures that the pin 64 lies in the plane of movement of the abutments 52 when the pin 64 is located at the distal end of the groove 70.

As a result, when the strip 50 is moved a sufficient distance in the appropriate direction through the housing 12, an abutment 52 first contacts the pin 64 at the distal end of the groove 70, and then moves the pin 64 proximally against the force of spring 34. The abutment 52 continues moving the pin 64 and the piston 26 proximally until the pin reaches the second section of the camming surface. The camming surface then forces the pin 64 to move out of the plane of movement of the abutment 52 such that the abutment 52 moves under the pin 64. As the abutment 52 continues is proximal movement, the pin 64 separates from the abutment 52 thereby releasing the piston 26 for movement from the fired position to the cocked position. The piston 26 thus moves forward under the force of spring 34. As it moves forward, the piston 26 forces air from the chamber 20 into the station 42 located in the firing position. The forward movement of the piston 26 returns the pin 64 to the distal end of the groove 70 where it awaits the next abutment 52 to start another firing cycle.

Preferably, the abutments 52 are spaced along the strip 50 such that the reciprocating movements of the piston 26 and the rotational movements of the magazine 40 are synchronized. In other words, the abutments 52 are preferably located such that a new station 42 is positioned in the firing position every time the piston 26 is released to move from the cocked position to the fired position. Persons of ordinary skill in the art will also appreciate that the abutments 52 are preferably spaced along the strip 50 such that the piston 26 can move from the cocked position to the fired position without interference from the abutments 52.

In the preferred embodiment, a first end of the strip 50 extends out of an aperture 74 defined at the proximal end of the housing 12 and the second end of the strip 50 extends out of an aperture 76 defined in the handle 14 of the apparatus 10. The strip 50 is threaded through the housing 12 between the apertures 74, 76. A flywheel 80 is provided within the housing 12 to manage the strip 50 within the housing 12 and to facilitate smooth movement of the strip 50. As shown in FIGS. 7 and 8, handles 82 are preferably provided at the opposite ends of the strip 50 to enable a user to pull the strip 50 in a reciprocating fashion between a loaded position (FIG. 7) and a fired position (FIG. 8).

Figure 10:
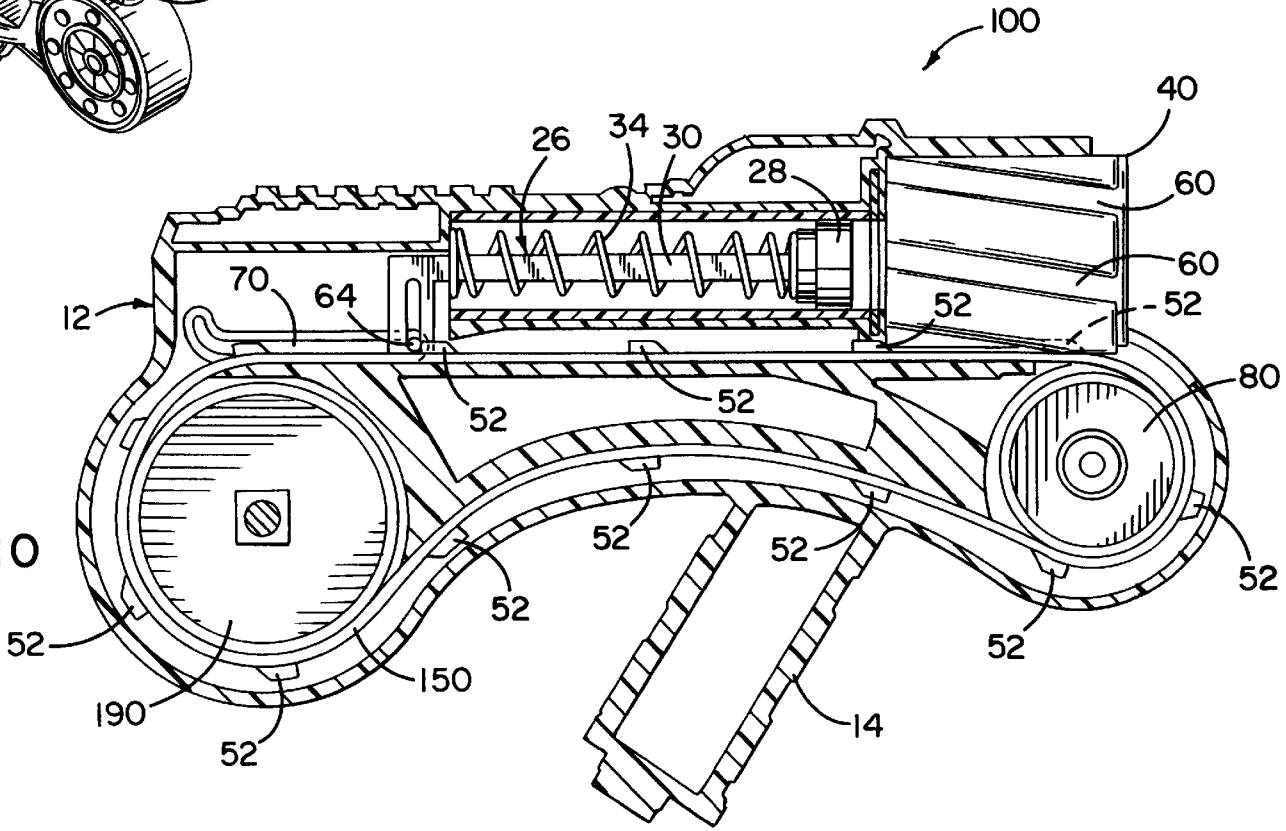
FIG. 10 is a cross-sectional view of the second toy gun of FIG. 9.
Figure 9:
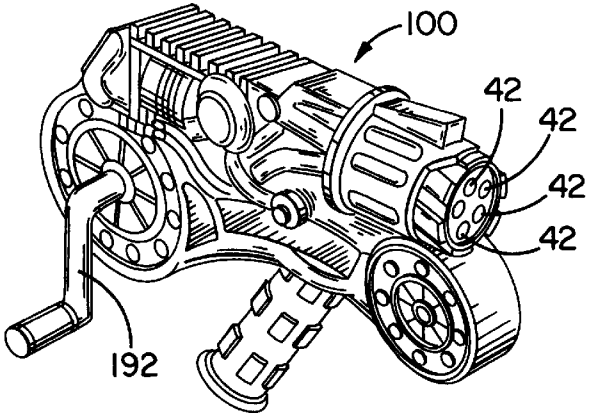
FIG. 9 is a right, front perspective of a second toy gun constructed in accordance with the teachings of the invention.

As shown in FIGS. 7 and 8, the abutments 52 preferably include a front surface which is oriented for moving the pin 64 along the groove 70 and a rear surface configured as a ramp to facilitate the abutments 52 moving under the pin 64 when the strip 50 is moved from the fired position toward the loaded position. Another toy gun 100 constructed in accordance with the teachings of the invention is shown in FIGS. 9 and 10. As the toy gun 100 is similar in many respects to the toy gun 10, in the interest of brevity, descriptions of the common structures will not be repeated here. Instead, interested readers are referred to the above description of toy gun 10 for an enabling description of the best mode of implemented those like components. To facilitate this process, the most significant common structures have been numbered using the same reference numerals in FIGS. 9–10 as they have in FIGS. 1–8 and the above description.

The toy gun 100 differs from the toy gun 10 in that the actuating means of the toy gun 100 is implemented by an endless strip 150. As shown in FIG. 10, at one end, the endless strip 150 is wrapped around the flywheel 80 and, at the other end, the strip 150 is wrapped around a gear 190. The gear 190 frictionally engages the back surface of the strip 150 or, alternatively, includes teeth for mating with apertures defined in the strip 150 in a conventional manner, such that rotation of the gear 190 imparts a rotational movement to the strip 150 which, in turn, synchronously actuates the magazine 40 and piston 26 to sequentially fire projectiles 112 from the gun 100. In the illustrated embodiment, rotational movement is imparted to the gear 190 via an external hand crank 192 (see FIG. 9) which is connected to the center of the gear 190. Optionally, the crank 192 may be coupled to the gear 190 via a gear train (not shown).

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. A toy gun for firing projectiles with air pressure comprising:

a housing defining a chamber;

a piston arranged for reciprocating motion relative to the chamber between first and second positions, the piston forcing air from the chamber when it moves from the first to the second position;

a piston spring for biasing the piston towards the second position;

a magazine having at least two stations, each of the stations being adapted to receive a projectile, the magazine being movable for sequentially positioning each of the stations in a firing position to receive the air forced from the chamber by the piston; and, an elongated strip in operative engagement with the piston and the magazine for actuating the piston and the magazine in synchronization such that air forced from the chamber by the piston is sequentially applied to the at least two stations whereby at least two projectiles can be fired by a single cycle of the strip, the strip being movable relative to the piston and the magazine and including at least two spaced abutments for periodically operatively engaging the piston and the magazine.

2. A toy gun as defined in claim 1 wherein the piston includes a projection for operatively engaging the elongated strip.

3. A toy gun as defined in claim 2 wherein the projection rides along a camming surface as the piston reciprocates between the first and second positions.

4. A toy gun as defined in claim 3 wherein the camming surface forces the projection to separate from the elongated strip when the piston reaches the first position thereby releasing the piston for movement from the first position to the second position.

5. A toy gun as defined in claim 4 wherein at least one of the abutments periodically operatively engages the projection to thereby impart movement of the strip to the piston.

6. A toy gun as defined in claim 5 wherein the abutments are spaced to periodically permit the piston to move from the first position to the second position without interference therefrom.

7. A toy gun as defined in claim 3 wherein the camming surface has a first section at its distal end which is oriented substantially parallel to the plane of movement of the piston, and a second section at its proximal end having a component which is oriented transverse to the plane of movement of the piston.

8. A toy gun for firing projectiles with air pressure comprising: a housing defining a chamber;

a piston arranged for reciprocating motion relative to the chamber between first and second positions, the piston forcing air from the chamber when it moves from the first to the second position;

a piston spring for biasing the piston towards the second position;

a magazine having at least two stations, each of the stations being adapted to receive a projectile, the magazine being movable for sequentially positioning each of the stations in a firing position to receive the air forced from the chamber by the piston; and, actuating means in operative engagement with the piston and the magazine for actuating the piston and the magazine in synchronization such that air forced from the chamber by the piston is sequentially applied to the at least two stations whereby at least two projectiles can be fired by a single cycle of the actuating means, wherein the piston includes a pin for operatively engaging the actuating means, the pin being mounted for movement within a slot defined in the piston.

9. A toy gun as defined in claim 1 wherein the magazine is substantially cylindrical and includes a groove on its outer periphery, the strip periodically interacting with the groove to rotate the magazine through a predefined angle.

10. A toy gun as defined in claim 9 wherein at least one of the abutments periodically operatively engages the groove to thereby impart movement of the strip to the magazine.

11. A toy gun as defined in claim 10 wherein the abutments are spaced to synchronize the reciprocation of the piston with the rotation of the magazine.

12. A toy gun as defined in claim 1 wherein the strip extends beyond the housing and includes a first handle to facilitate pulling of the strip by a user.

13. A toy gun as defined in claim 12 wherein the strip includes a second handle at an end of the strip opposite the first handle whereby the strip can be reciprocated through the housing between a loaded position and a fired position.

14. A toy gun as defined in claim 1 further comprising a flywheel for managing the strip within the housing.

15. A toy gun as defined in claim 1 further comprising a projectile.

16. A toy gun as defined in claim 1 wherein the magazine includes more than two stations.

17. A toy gun as defined in claim 1 wherein the strip is endless.

18. A toy gun as defined in claim 17 further comprising a crank and a gear for rotating the strip to thereby sequentially fire the toy gun.

19. A toy gun for firing projectiles comprising:

a housing;

a piston for developing a firing force;

a magazine having at least two stations, each of the stations being adapted to receive a projectile, the magazine being movable for sequentially positioning each of the stations in a firing position to receive the firing force developed by the piston; and, an elongated strip in operative engagement with the piston and the magazine, the elongated strip including a plurality of spaced abutments for periodically actuating the piston and the magazine such that force developed by the piston is sequentially applied to the at least two stations.

20. A toy gun as defined in claim 8 wherein the pin rides along a camming surface as the piston reciprocates between the first and second positions.

21. A toy gun as defined in claim 20 wherein the camming surface forces the pin to separate from the actuating means when the piston reaches the first position thereby releasing the piston for movement from the first position to the second position.

22. A toy gun as defined in claim 21 wherein the actuating means comprises an elongated strip which is movable relative to the piston and magazine, the strip includes a plurality of spaced abutments, and at least one of the abutments periodically operatively engages the pin to thereby impart movement of the strip to the piston.

23. A toy gun as defined in claim 22 wherein the abutments are spaced to periodically permit the piston to move from the first position to the second position without interference therefrom.

24. A toy gun as defined in claim 21 wherein the camming surface has a first section at its distal end which is oriented substantially parallel to the plane of movement of the piston, and a second section at its proximal end having a component which is oriented transverse to the plane of movement of the piston.

* * * * *